United States Patent [19]

Harris

[11] Patent Number: 4,862,967

[45] Date of Patent: Sep. 5, 1989

[54] METHOD OF EMPLOYING A COATED ELASTOMERIC PACKING ELEMENT

[75] Inventor: Gary L. Harris, Houston, Tex.

[73] Assignee: Baker Oil Tools, Inc., Orange, Calif.

[21] Appl. No.: 220,581

[22] Filed: Jul. 18, 1988

Related U.S. Application Data

[63] Continuation of Ser. No. 862,138, May 12, 1986, abandoned.

[51] Int. Cl.[4] ..... E21B 33/12; E21B 33/13; F16J 15/10

[52] U.S. Cl. ..... 166/387; 277/1; 277/70; 277/228; 277/DIG. 6; 166/179

[58] Field of Search ..... 277/1, 30, 70, 75, 227, 277/228, DIG. 6, 212 R, 212 C; 166/118, 121, 217, 179, 135, 387, 902, 185, 186; 427/430.1

[56] References Cited

U.S. PATENT DOCUMENTS

| | | | |
|---|---|---|---|
| 2,597,976 | 5/1952 | Cousins | 277/228 |
| 2,643,147 | 6/1953 | Funkhouser et al. | 277/212 X |
| 2,868,575 | 1/1959 | Hawthurst | 277/228 |
| 3,148,895 | 9/1964 | Jasper et al. | 277/228 X |
| 3,799,454 | 3/1974 | Blackwell . | |
| 3,988,148 | 6/1961 | Conrad et al. | 277/70 |
| 4,088,830 | 5/1978 | Wavgin | 174/113 R |
| 4,119,325 | 10/1978 | Oakley et al. | 277/207 R |
| 4,234,197 | 11/1980 | Amancharla | 277/124 |
| 4,234,758 | 11/1980 | Guzy | 174/DIG. 8 |
| 4,296,806 | 10/1981 | Taylor et al. | 277/235 R |
| 4,419,844 | 12/1983 | Kreisfeld | 49/475 |

FOREIGN PATENT DOCUMENTS

| | | | |
|---|---|---|---|
| 633757 | 2/1962 | Italy . | |
| 613080 | 6/1978 | U.S.S.R. | 166/179 |
| 905431 | 2/1982 | U.S.S.R. | 166/179 |
| 972041 | 11/1982 | U.S.S.R. | 166/118 |

OTHER PUBLICATIONS

A Guide to Dow Corning Products, Form No. 01-32-0-77, Copyright 1977, by Dow Corning Corp., Midland, Mich. 48640, cover page, and pp. 2, 3, 5, and 21 included.

"Geothermal Elastomeric Materials (GEM) Program", by A. R. Hirasuna et al., San-1308-2, Jul. 1979, (pp. IV, V, 30, 32, 33, 35, and 60).

"Y267 EPDM Elastomer In Hydrocarbons Important and Unexpected Very High Temperature Case Histories", Corrosion 84, Paper No. 137, pp. 137/1 to 137/40 (NACE Publication), Apr. 84.

*Primary Examiner*—Allan N. Shoap

*Attorney, Agent, or Firm*—Hubbard, Thurman, Turner & Tucker

[57] ABSTRACT

This invention relates to a method for achieving a seal by an expandable packing element having a generally tubular configuration and being fabricated from elastomeric material adapted to be utilized in conjunction with a packer apparatus within a well bore conduit during the completion or workover of a subterranean oil or gas well. Preferably the packing element is formed from a resilient elastomeric material such as ethylene propylene diene monomer adapted to withstand elevated temperatures and high pressures in subterranean wells. The tubular body member has an imperforate protective coating at least over its exterior surfaces, the coating being resistant to exposure to steam and hydrocarbons at elevated temperatures for extended periods for protection of the body member prior to its controlled expansion into well sealing relation, said coating becoming imperforate by said expansion.

2 Claims, 1 Drawing Sheet

METHOD OF EMPLOYING A COATED ELASTOMERIC PACKING ELEMENT

This is a continuation of application Ser. No. 862,138, filed May 12, 1986, now abandoned.

BACKGROUND OF THE INVENTION

1. Field of the Invention

This invention relates to an improved packing element designed for use in completion and production operations of oil and gas wells wherein the expandable element is coated against exposure to hydrocarbons at elevated temperatures which prevents the element from unduly distending or elongating prior to its being sealed within the well bore.

2. Description of the Prior Art

Typically, expandable packing elements such as plug assemblies, bridge plugs, drillable packers, inflatable packers, and rotational locking sealing packers are used in subterranean wells in combination with various types of packer assemblies which are selectively located within a well casing in order to isolate one or more of the production zones of the well. Such packing elements are mounted within a packer assembly at the well head and the entire unit is run down into the well casing and secured at a selected location along the casing, normally adjacent production formations. When it is desired to operate the packer assembly to release a sealing plug or distend a packing element, a tubing string having a suitable actuator attached to its lower end is run down into the well casing to contact the plug or packing assembly, normally by applying sufficient downward force to the plug or packer assembly, the plug becomes disengaged from the packer assembly and free falls to the bottom of the well, such as in the form of an expendable plug, or the packer assembly is operated to distend the packing element radially to seal a well annulus, for example.

During the movement of tubing into the lowermost extremities of tuhe well, the sealing elements of packer apparatus during completion and production operations are subjected to high temperature and high pressure in oil and gas wells which has caused preliminary damage or deterioration of the sealing systems which utilize elastomeric packing elements. Damage to such elements has become a greater problem during present day intensive searching for new oil and gas reserves wherein the drilling and subsequent completion is being effected in deeper wells involving greater exposure to extremely hostile, high temperature environments where the well production may contain not only the desired hydrocarbons but significant amounts of hydrogen sulfide, carbon dioxide and methane, all of which are detrimental to elastomeric materials at elevated temperatures.

To overcome these conditions and successfully complete such a well the packer apparatus, including its elastomeric expandable packing element, must be capable of continuous sealing integrity and must be protected from damage from the aforesaid adverse environment prior to its sealing disposition in the desired location. The packing element must be resistant to the well environment, i.e. temperature, pressure, well fluids, and the like, but also to physical stresses imposed on the packing assembly during or resulting from completion or workover procedures.

One type of prior art seal system is disclosed in U.S. Pat. No. 2,862,563 illustrating a well packer apparatus for packing the annular space between tubing in a well wherein resilient annular packing elements are spaced about a tubular mandrel. U.S. Pat. No. 3,083,785 discloses the use of a formation packer in which a plurality of resilient annular packing elements are spaced about a tubular mandrel and a plurality of folded metal plates are mounted on a double traveling mandrel. U.S. Pat. No. 3,531,236 discloses a tubular sealing assembly utilizing chevron-shaped sealing rings formed from a fluoroelastomer and asbestos with a fluorocarbon plastic ring adapters at each end of the seal stack. U.S. Pat. No. 2,467,822 discloses the use of a rubber or similar packing material which is prevented from flowing through the opening between the packer body and the packing retainer or abutment surrounding the body.

The prior art also discloses a number of generic sealing systems having utility in the sealing of a well conduit. U.S. Pat. No. 3,467,394 discloses a packing element of a V-ring type wherein the packing arrangement comprises a polytetrafluoroethylene commonly sold under the trademark "Teflon" with relatively rigid V-ring shaped spacer rings interposed between a plurality of elastomeric V-rings. Also U.S. Pat. No. 4,050,701 discloses ring seals obtained from a mixture of polyphenylene sulfide and polytetrafluoroethylene for use in the fluid sealing of rotary or reciprocating shafts. Additionally, U.S. Pat. No. 3,626,337 discloses a packing ring for use in high temperature and high pressure environments wherein the thermoplastic type composition, such as rubberized nylon, tetrafluoroethylene polyesters, acrylics and the like, are laminated to form a composite sealing material. U.S. Pat. No. 3,799,454 discloses a coating composition containing polytetrafluoroethylene and polyethylene sulfide for formation of a seal system.

In general, the sealing systems of the prior art have not been totally satisfactory for use in modern-day wells having high bottom hole temperatures and pressures as well as containing corrosive fluids. Various types of newly available elastomeric materials have been utilized in packer seal systems, such elastomeric materials such as polytetrafluoroethylene sold under the trademark "Teflon", a polymer of polyphenylene sulfide sold under the trademark "Ryton", and a perfluoroelastomer sold under the trademark "Kalrez".

Polytetrafluoroethylene is a flexible fluoropolymer having a high degree of permanent set and cold flow exhibiting high resistance to corrosive chemicals and high temperatures. It is frequently used in combination with suitable fillers to improve its properties, especially resistance to high temperatures. Polyphenylene sulfide is a thermoplastic resin which exhibits high thermal stability, excellent chemical resistance, and good affinity for retaining fillers. The perfluoroelastomer is another material characterized by high thermal stability and excellent chemical resistance. All of the aforesaid elastomeric materials have been employed in packer seal systems but not with complete success under all conditions in deeper wells. It has been found that sealing systems which incorporate such elastomeric materials have a definite tendency to adhere or stick to the well conduit when exposed to high temperatures when the sealing system must be retrieved from the well or be relocated to a different position.

Sticking of the seal system which can occur in multiple seal assemblies, for example, is not the only problem inherent with the aforesaid elastomers, but ease of fabrication and expense require that the elastomer material be one capable of resisting both steam and hydrocarbons when used in both geothermal and hydrocarbon wells without undue swelling or elongation of the material prior to its controlled expansion or distension into sealing relation. In some cases the running in of the packer assembly may require periods as long as 24 hours and the packing element may be subjected to temperatures ranging from 0° to 600° F. Longer time periods may occasionally be required where the packer assembly must be capable of withstanding several trips into the well prior to setting the packing element.

SUMMARY OF THE INVENTION

The present invention relates to a method for achieving a seal by an improved packing element preferably comprised of an ethylene-propylene diene monomer (EPDM) which has been found to be highly desirable for use in both geothermal and hydrocarbon wells. The EPDM elastomer has been found to be capable of withstanding geothermal brine at 500° F. containing 300 ppm hydrogen sulfide, 1,000 ppm carbon dioxide and 25,000 ppm sodium chloride in aqueous solution for 24 hours. The base elastomeric material comprises the body member the packing element and is coated with a more highly hydrocarbon resistant coating material which is capable of protecting its exposed surfaces prior to setting of the packer. The subject packing element is characterized by its ability to withstand hostile environments which have high pressures and high temperatures, corrosive chemicals, including both liquids and gases.

The subject packing element comprises a sleeve-like resilient expandable body member having a generally cylindrical exterior surface adapted to seal tightly against the wellbore or casing, the member preferably being formed of the elastomeric ethylene-propylene diene monomer. A continuous imperforate protective coating, such as a fluorocarbon, polytetrafluoroethylene or silicone rubber, is applied over at least the exterior surfaces of the packing element to provide protection against exposure to hydrocarbons and steam at elevated temperatures for extended periods prior to setting the packing element in the well bore. The coating may be applied over essentially all exposed surfaces of the packing element having a sufficient thickness to provide protection against deleterious effects when exposed to hydrocarbons over the temperature range of about 0° to about 600° F. The EPDM rubber material is one selected as having a low degree of permanent set and cold flow and which is applicable to utilization in unusually severe environments. Such packing element is also capable of withstanding high temperature geothermal brine when utilized in geothermal wells in meeting the requirements of providing good flexibility when used in a wide variety of well packing situations. The impervorate protective coating is selected to become perforate by expansion of the expandable body member.

DESCRIPTION OF THE PREFERRED EMBODIMENT

Figure 1:
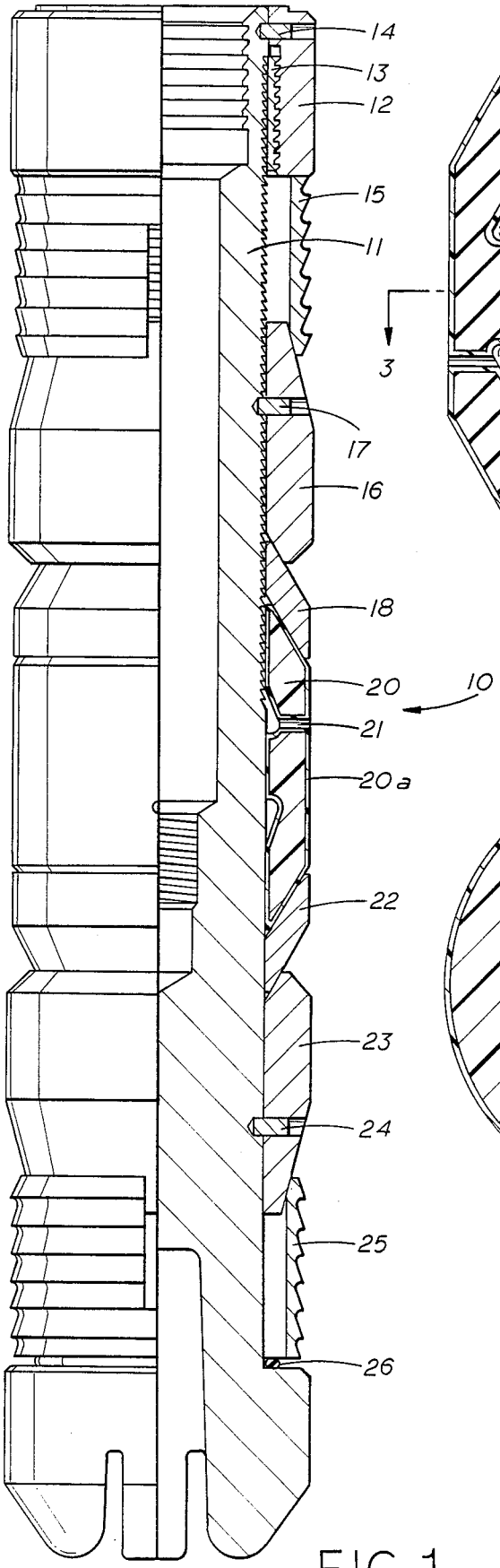
FIG. 1 is a partially sectionalized elevational view of a packer assembly showing the packing element mounted within a central region.
Figure 2:
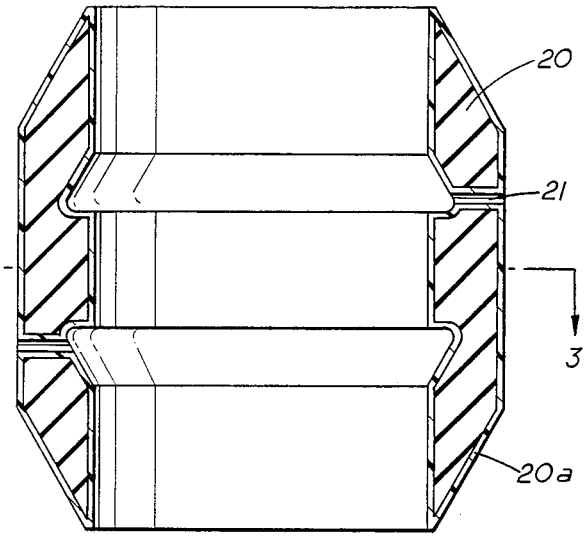
FIG. 2 is a vertical sectional view of the packing element shown in FIG. 1.
Figure 3:
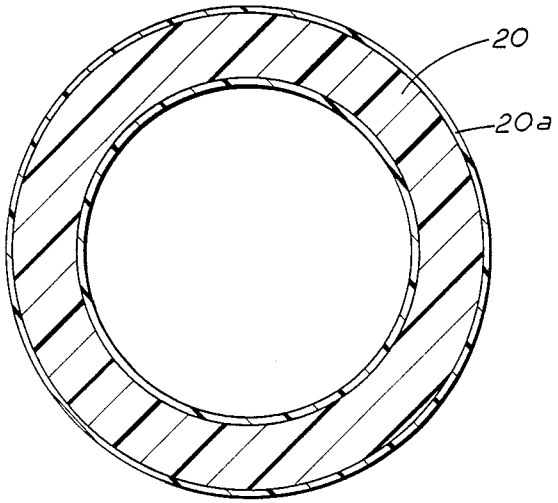
FIG. 3 is a view of the packing element taken along the line 3—3 of FIG. 2.

A high-temperature wireline bridge plug designated by the numeral 10 is shown in FIG. 1. Such bridge plug is representative of many different types of packing assemblies and is shown for illustrating one application of a resilient packing element for sealing a well. The bridge plug has a lengthy tubular body member 11 which is contoured at both ends to facilitate the mounting of a body lock support ring 12 as shown at the upper end. An intermediate threaded body lock ring 13 is threadingly mounted between support ring 12 and body member 11. A shear pin 14 is mounted between support ring 12 and body 11. A slip member 15 is mounted exteriorly between support ring 12 and a cone member 16, the latter being attached by a shear pin 17. A packing ring 18 is mounted intermediate upper cone member 16 and a resilient sleeve-like tubular packing element 20. The packing element has a tubular configuration to closely surround body 12 at a central region. Element 20 has one or more apertures 21 therein, and a cylindrical shape at its central area and frusto-conical contours at its ends complementally shaped to the interiors of upper and lower packing rings 18 and 22. A lower cone 23 is mounted below ring 22, having a shear pin 24 in the same manner as cone 16. A lower slip member 25 is mounted below cone 23 having an O-ring 26 at a lower region between the slip member and the body member. The packing element 20 has an exterior thin coating **20*a* over all its exterior surfaces, as shown in FIGS. 2 and 3**. The following description is directed to the resilient packing element of this invention.

In operating the subject bridge plug, the cone members and their adjacent packer rings are forced together to distend the packing element 20 radially into sealing engagement with the well bore or casing.

In the evaluation of various elastomers for use as sealing elements in hydrocarbon producing wells, ethylenepropylene diene monomer rubber (EPDM) when utilized alone has generally been found to offer undesirable characteristics in providing satisfactory performance in the presence of hydrocarbons in deep wells. Various data based on immersion tests have shown that such elastomers generally show extreme swelling and degradation of properties when exposed to the presence of hydrocarbons. In environments wherein EPDM rubber has been evaluated for geothermal and deep hydrocarbon well applications immersion test data have been found to be the preferred test criteria for evaluating elastomers for given applications. Chemical resistance of the elastomer at high temperature has been one of the most important characteristics in evaluating the performance of the material for use in a packing assembly.

As is known, elastomers are usually a relatively weak material and as pressure increases there is an attendant increase in the mechanical stresses which the elastomer must withstand. Further, as the temperature increases the strength of the elastomer decreases significantly, thus rendering it less capable of withstanding higher pressures. Temperatures in the range of 300°–400° F. result in serious decreases in the physical capabilities of rubber which is particularly noted at 300° F. For example, the tensile strengths of many elastomers are only about 15% of their ambient temperature strength values in such temperature range. It has been found that evaluating the elastomers at elevated temperatures and under significant mechanical stresses has been a much more satisfactory procedure in determining their operational capability.

A preferred type of EPDM elastomer is EPDM formulation No. 267 having the following composition:

| Component | Parts |
|---|---|
| Nordel 1660 | 100 phr |
| Polybutadiene #6081 | 20 |
| Statex 160 | 75 |
| Cyanox 2246 | 0.5 |
| Di Cup R | 3.5 |
| Thermoguard S | 5 |
| Hypalon 20 | 5 |
| Press Cure | 350° F./60 minutes |
| Post Cure | $N_2$ atmosphere<br>350° F. preheat<br>50° F./hr. step-up to 550° F. started at insertion<br>550° F. for 5 hrs. |

The Nordel 1660 is a non-crystalline monomer of ethylene/propylene/diene with a narrow molecular weight distribution and a nominal Mooney viscosity of 60 (ML/121° C.) made by the duPont Company. The Polybutadiene #6081 is a high-vinyl 1,2 polybutadiene resin made by Polysciences, Inc. The Statex 160 is a N110 carbon black per ASTM D1765, Iodine No. 145, DBP No. 113 made by Cities Service Company. Cyanox 22465 is 2,2 methylene(4-methyl-6-t butyl)phenol, Specific gravity 1.09, melting point 130° C., made by American Cyanamid Company. Di Cup R is dicumyl peroxide, 96–99% made by Harwick Chemical Corporation. Thermoguard S is antimony trioxide, 70.3%, made by M & T Chemicals, Inc. The Hypalon 20 is a chlorosulfonated polyethylene 29% chlorine, 1.4% sulfur, specific gravity 1.12 made by the duPont Company. The "phr" units mean per hundred parts of rubber.

Previously, EPDM rubber has generally been eliminated from use in hydrocarbon environments because of its swelling. Swelling of the material prior to its controlled expansion in the case of a packing element indicates its apparent weakness which has heretofore essentially ruled out its application in hydrocarbon environments. The most common occurrence at high temperatures and pressures is for such elastomeric materials to swell prior to its being controllably expanded or radially positioned into sealing relation.

In the present invention it has been found that coating the EPDM rubber packing element 20 with a thin film 20*a* of a fluorocarbon, polytetrafluorethylene or silicone rubber has been capable of protecting the EPDM material prior to its controlled expansion into sealing relation. Fluorocarbons which are manufactured and sold by the 3M Company under the trademark "Fluorel" brand fluoroelastomers have been found to be especially useful for coating the EPDM rubber. Such fluorocarbons have been previously utilized in applications for forming various types of O-rings, molded packings, oil seals and the like, such materials offering durability in normally hostile environments as well as good chemical resistance. Three types of such fluorocarbons are Product Nos. FC-2120 and FC-2145 and FC-2178 which are designated as Flurorel elastomer gums without incorporated curing. Such products have the following properties which are particularly useful for coating the EPDM rubber:

Fluoroelastomer Coating

| | FC-2120 | FC-2145 | FC-2178 |
|---|---|---|---|
| Specific Gravity | 1.80 | 1.81 | 1.82 |
| Fluorine % | 65 | 65 | 65 |
| Mooney Viscosity ML (1 + 10) @ 250° F. | 23 | 18 | 120 |
| Tensile, psi | 1800 | 2000 | 2540 |
| Elongation % | 220 | 200 | 290 |
| 100% Modulus, psi | 675 | 800 | 615 |
| Hardness Shore A | 76 | 73 | 74 |
| Compression Set % | 20 | 48 | 51 |

The EPDM rubber may also be coated with a polytetrafluoroethylene polymer such as Teflon made by the DuPont Company. Also Teflon material having a thickness of about 0.030 inch distributed by the Plastic Consulting Manufacturing Company of Camden, N.J., may be utilized for the coating. Also, a silicone rubber material such as Product No. FRV-1106, manufactured by the General Electric Company, or a fluorosilicone rubber may also be utilized for the coating.

The packing element 20 having a generally cylindrical body member is mounted within a packing apparatus 10 such as shown in FIG. 1 of the drawings. The element 20 may be coated with one of the aforesaid coating materials, such as by dipping the packing element into a bath of the coating material or brushing on the material to cover at least the exteriorly exposes surfaces of the packing element. The coating 20*a* in the form of a thin film preferably having a thickness ranging from about 0.005 to 0.040 inch is employed as a continuous imperforate coating and may extend over essentially all exposed surfaces of the packing element. Test effects of the various coatings on the EPDM rubber packing element have been conducted on a packing element having the configuration shown in FIG. 1. The tests were conducted at 250° F. in kerosene and at atmospheric pressure to evaluate swelling and elongation of the packing element. The coated element has been shown to resist swelling and elongation for extended periods when exposed to 250° F. kerosene for periods of up to 8 hours.

Tests were also conducted using O-rings fabricated of EPDM rubber having a cross-section of 0.209 inch to study swelling in various hydrocarbons. The tests utilized atmospheric pressure and hydrocarbon fluids at 250° F. which has been shown to cause swelling of the uncoated O-rings. The O-rings were measured every 30 minutes for approximately 4 hours, the measurement being conducted by checking the external diameter only. It was shown that diesel oil and kerosene cause severe swelling of the uncoated EPDM while swelling was not as severe when the O-rings were exposed to other hydrocarbons. The coated O-rings were shown to exhibit considerably lesser swelling and elongation than those which were uncoated when exposed to the same hydrocarbon conditions for approximately 4 hours.

Tests were conducted on EPDM rubber in both coated and uncoated condition, the tests being conducted in kerosene at 250° F. and at atmospheric pressure. The uncoated EPDM rubber was shown to swell and elongate in uncoated condition while the aforesaid coatings were shown to markedly resist swelling and elongation for periods of up to 8 hours, and in some cases as long as 24 hours.

The coating of EPDM elastomer has been shown to reduce swelling and elongation of the base material to less than about 15% of its original dimensions on hydrocarbon exposure for up to 24 hours.

In the case of coated packing elements, the coating serves to protect the element from swelling effects when the packing apparatus is run into the well, while exposed to hydrocarbons and other corrosive fluids. When the packing element is expanded and set in the desired sealing location, the coating is disrupted but does not interfere with durable permanent sealing of the packing element. At such time the continuity of the coating is broken, but the element can be seated in its normal manner without loss of sealing integrity.

Although the invention has been described in terms of the specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A method of providing a sealing surface for a packer to be set in a subterranean well in association with the tubing string for sealing the well bore to isolate the annulus between the well bore and the tubing string above the packer from that portion of the well bore below the packer, said method comprising the steps of:

(1) providing said packer with a radially expandable tubular body member having a cylindrical exterior surface adapted to seal tightly against the well bore when said tubular member is radially expanded, said body member being formed of an elastomeric ethylene-propylene diene monomer;

(2) coating over at least the major exposed exterior surfaces of said tubular body member with a continuous imperforate elastomeric coating being resistant to permeation by hydrocarbons in said well bore at temperatures above about 250° F. for periods in excess of about 4 hours for delaying swelling of said body member from exposure to the hydrocarbons prior to setting the packer in the well bore; said coating being rendered permeable by expansion of said tubular body member;

(3) running said packer in said well bore to a position proximate a predeterminable location;

(4) setting said packer whereby the tubular body member is allowed to swell by permeation through the coating to provide optimum sealing subsequent to setting of said packer.

2. The method of claim 1 wherein essentially all surfaces of said tubular member are coated with a thin continuous coating of hydrocarbon-resistant material capable of protecting said tubular member prior to setting of the packer in the well bore against undue distension from hydrocarbon exposure over the temperature range of about zero degrees to about 600° F.

* * * * *